US009828921B2

(12) United States Patent
Seldon et al.

(10) Patent No.: US 9,828,921 B2
(45) Date of Patent: Nov. 28, 2017

(54) EXTERNAL VEHICLE SOUND FIELD ENHANCEMENT

(71) Applicant: GM Global Technology Operations LLC, Detroit, MI (US)

(72) Inventors: William Seldon, Highland, MI (US); Scott M. Reilly, Southfield, MI (US); Grant Brady, Howell, MI (US); Randall S. Beikmann, Brighton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/004,288

(22) Filed: Jan. 22, 2016

(65) Prior Publication Data

US 2017/0107921 A1 Apr. 20, 2017

Related U.S. Application Data

(60) Provisional application No. 62/243,318, filed on Oct. 19, 2015.

(51) Int. Cl.

| | |
|---|---|
| ***F01N 1/00*** | (2006.01) |
| ***F01N 5/04*** | (2006.01) |
| ***F02D 33/02*** | (2006.01) |
| *F02D 41/14* | (2006.01) |
| *G10K 11/22* | (2006.01) |

(52) U.S. Cl.

CPC ..... *F02D 33/02* (2013.01); *F02D 41/1448* (2013.01); *F02D 2200/025* (2013.01); *F02D 2200/0406* (2013.01); *G10K 11/22* (2013.01)

(58) Field of Classification Search

CPC ..... F01N 1/24; F01N 1/02; F01N 1/04; F01N 1/10; F01N 1/065; F02D 2200/025; F02D 2200/0406; F02D 33/02; F02D 41/1448; G10K 11/22

USPC ..... 60/313, 323, 324

See application file for complete search history.

(56) References Cited

U.S. PATENT DOCUMENTS

| | | | | |
|---|---|---|---|---|
| 5,692,052 | A * | 11/1997 | Tanaka | F01N 1/065 381/71.11 |
| 6,210,149 | B1 * | 4/2001 | Plavnik | F23C 15/00 431/1 |
| 2013/0142352 | A1 * | 6/2013 | Koch | G10K 15/02 381/86 |

FOREIGN PATENT DOCUMENTS

| | | |
|---|---|---|
| JP | 63255518 | * 10/1988 |
| JP | 2010-248980 | * 11/2010 |
| KR | 2003-018943 | * 3/2003 |

OTHER PUBLICATIONS

U.S. Appl. No. 15/079,790, filed Mar. 24, 2016, Ali Khan et al.

(Continued)

*Primary Examiner* — Thai Ba Trieu
*Assistant Examiner* — Diem Tran

(57) ABSTRACT

An engine sound enhancement system includes a conduit in communication with at least one of an intake manifold and an exhaust manifold of an engine. An interface is arranged at least one of within the conduit and between an inlet of the conduit and the at least one of the intake manifold and the exhaust manifold. The interface is responsive to pulses within the at least one of the intake manifold and the exhaust manifold, wherein the interface is configured to transfer the pulses into the conduit.

15 Claims, 5 Drawing Sheets

(56) References Cited

OTHER PUBLICATIONS

Disclosed Anonymously, "Utilization of Turbocharger Actuators to Enhance Engine Sound Character", Research Disclosure database No. 616033, published digitally Jul. 8, 2015, 2 pages.

* cited by examiner

EXTERNAL VEHICLE SOUND FIELD ENHANCEMENT

CROSS-REFERENCE TO RELATED APPLICATIONS

This application claims the benefit of U.S. Provisional Application No. 62/243,318, filed on Oct. 19, 2015. The disclosure of the above application is incorporated herein by reference in its entirety.

FIELD

The present disclosure relates to internal combustion engines, and more specifically, to systems and methods for enhancing engine sounds.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Automotive vehicles, especially performance automotive vehicles, may implement one or more engine sound enhancement features. For example, as internal combustion engine technology improves with respect to combustion efficiency, emissions, fuel economy, engine output, etc., engine sound (both engine sound as experienced by a driver and/or passengers within the vehicle as well as engine sound external to the vehicle) may be significantly reduced. Accordingly, various engine sound enhancement features may be implemented to adjust the magnitude, frequency, tone, etc. of the sound generated by the engine through the exhaust system.

SUMMARY

An engine sound enhancement system includes a conduit in communication with at least one of an intake manifold and an exhaust manifold of an engine. An interface is arranged at least one of within the conduit and between an inlet of the conduit and the at least one of the intake manifold and the exhaust manifold. The interface is responsive to pulses within the at least one of the intake manifold and the exhaust manifold, wherein the interface is configured to transfer the pulses into the conduit.

An engine sound enhancement method includes providing a conduit in communication with at least one of an intake manifold and an exhaust manifold of an engine, and arranging an interface at least one of within the conduit and between an inlet of the conduit and the at least one of the intake manifold and the exhaust manifold. The interface is responsive to pulses within the at least one of the intake manifold and the exhaust manifold. The method further includes transferring the pulses into the conduit using the interface.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Various air intake, exhaust, and combustion components of an engine may affect sound generated by the engine. Some components may reduce or otherwise change the character of engine sound, which may be undesirable. For example, in turbocharged vehicles, a turbocharger may act as a sound filter and interfere with desired engine sounds. Engine sound enhancement systems and methods according to the principles of the present disclosure implement an engine sound enhancement device and/or engine sound flow path to enhance engine sounds.

Figure 1:
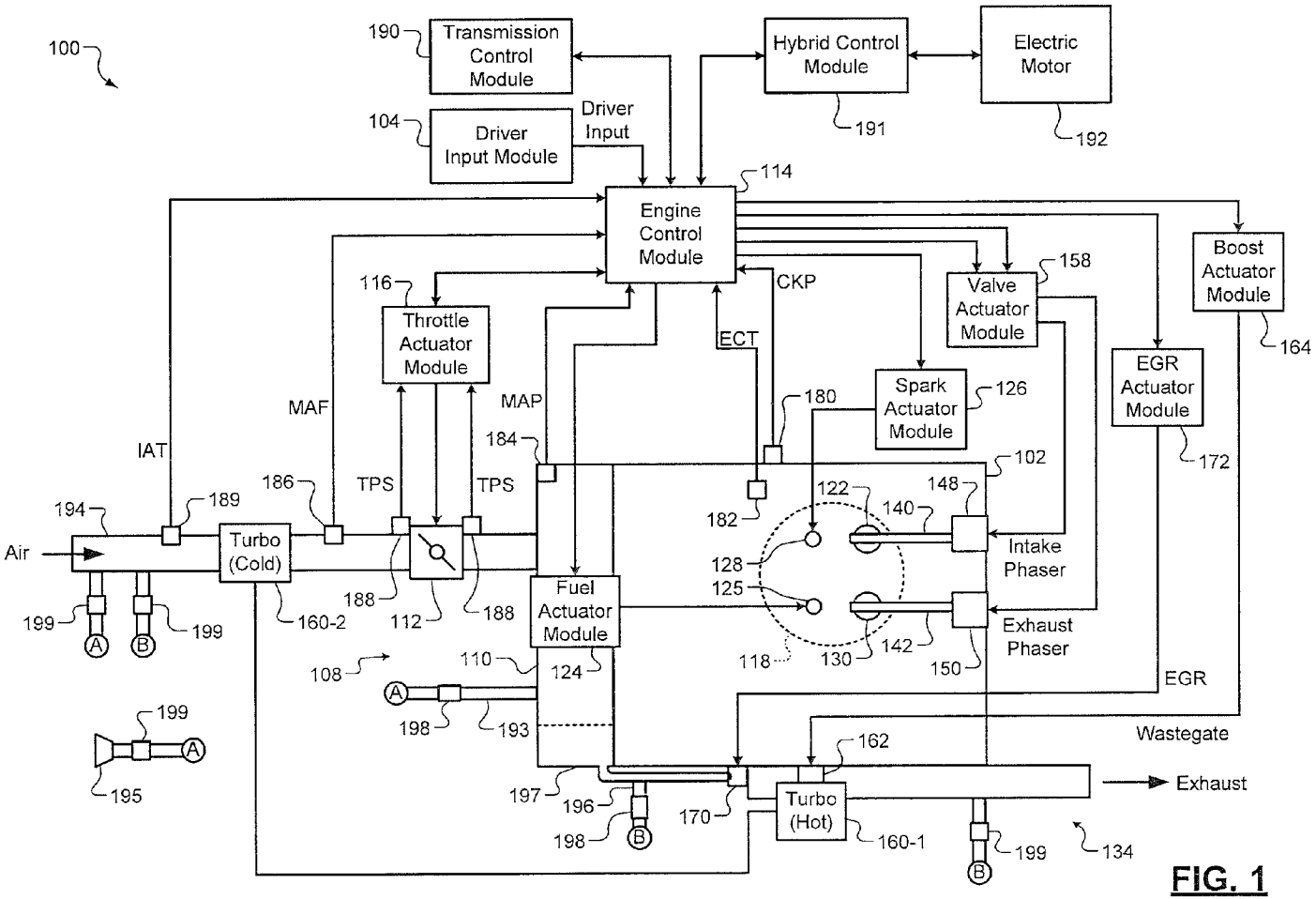
FIG. 1 is a functional block diagram of an example engine system according to the principles of the present disclosure.

Referring now to FIG. 1, an engine system 100 includes an engine 102 that combusts an air/fuel mixture to produce drive torque for a vehicle. Although described with respect to gasoline internal combustion engines, the principles of the present disclosure may also be applied to diesel fuel engines. The amount of drive torque produced by the engine 102 is based on a driver input from a driver input module 104. The driver input may be based on a position of an accelerator pedal. The driver input may also be based on a cruise control system, which may be an adaptive cruise control system that varies vehicle speed to maintain a predetermined following distance.

Air is drawn into the engine 102 through an intake system 108. The intake system 108 includes an intake manifold 110 and a throttle valve 112. The throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injections performed by a fuel injector 125 to achieve a desired air/fuel ratio. Fuel may be injected into the intake manifold 110 at a central location or at multiple locations, such as near the intake valve 122 of each of the cylinders. In various implementations, fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 to generate a spark in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a spark timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. A valve actuator module 158 may control the intake and exhaust cam phasers 148 and 150 based on signals from the ECM 114. When implemented, variable valve lift may also be controlled by the valve actuator module 158.

The ECM 114 may deactivate the cylinder 118 by instructing the valve actuator module 158 to disable opening of the intake valve 122 and/or the exhaust valve 130. The valve actuator module 158 may disable opening of the intake valve 122 by decoupling the intake valve 122 from the intake camshaft 140. Similarly, the valve actuator module 158 may disable opening of the exhaust valve 130 by decoupling the exhaust valve 130 from the exhaust camshaft 142. In various implementations, the valve actuator module 158 may actuate the intake valve 122 and/or the exhaust valve 130 using devices other than camshafts, such as electromagnetic or electrohydraulic actuators.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, which compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The exhaust system 134 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 may measure the position of the crankshaft using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 188. The ambient temperature of air being drawn into the engine 102 may be measured using an intake air temperature (IAT) sensor 189. The ECM 114 uses signals from the sensors to make control decisions for the engine system 100.

The ECM 114 may communicate with a transmission control module (TCM) 190 to coordinate shifting gears in a transmission (not shown). For example, the ECM 114 may reduce engine torque during a gear shift. The ECM 114 may communicate with a hybrid control module (HCM) 191 to coordinate operation of the engine 102 and an electric motor 192. The electric motor 192 may also function as a generator, and may be used to produce electrical energy for use by the vehicle's electrical systems and/or for storage in a battery. In various implementations, various functions of the ECM 114, the TCM 190, and the HCM 191 may be integrated into one or more modules.

The engine system 100 implements one or more engine sound enhancement features according to the principles of the present disclosure. For example, a conduit 193 may be provided in communication with the intake manifold 110. The conduit 193 provides a sound flow path from the intake manifold 110 to one or more other locations throughout the engine system 100. For example, the conduit 193 may provide sound flow between the intake manifold and an air intake (e.g., a cold air intake, snorkel, etc.) 194, and/or to an exterior of the vehicle (e.g., via external port 195). Alternatively or additionally, a conduit 196 may be provided in communication with exhaust manifold 197. The conduit 196 may provide a sound flow path from the exhaust manifold 197 to one or more other locations throughout the engine system 100 including, but not limited to, the air intake 194 and/or the exhaust system 134 (e.g., an exhaust pipe).

Each of the conduits 193 and 196 may include one or more engine sound enhancement devices 198. The engine sound enhancement devices 198 may include, but are not limited to, a mechanical device for amplifying sound (e.g., a membrane that resonates in response to sound pulses received through the conduits 193 and 196), an electronic device (e.g., a microphone and speaker), a combination mechanical and electronic device, etc. Each of the conduits 193 and 196 may also include one or more valves 199. The valves 199 may be actuated (i.e., opened and closed) to selectively provide and prevent engine sound enhancement. For example, the ECM 114 selectively actuates the valves based on various inputs and performance parameters, including, but not limited to, a selected performance mode and/or other user inputs, engine speed, torque, vehicle speed, other engine sound enhancement features, noise thresholds, etc.

Figure 2A:
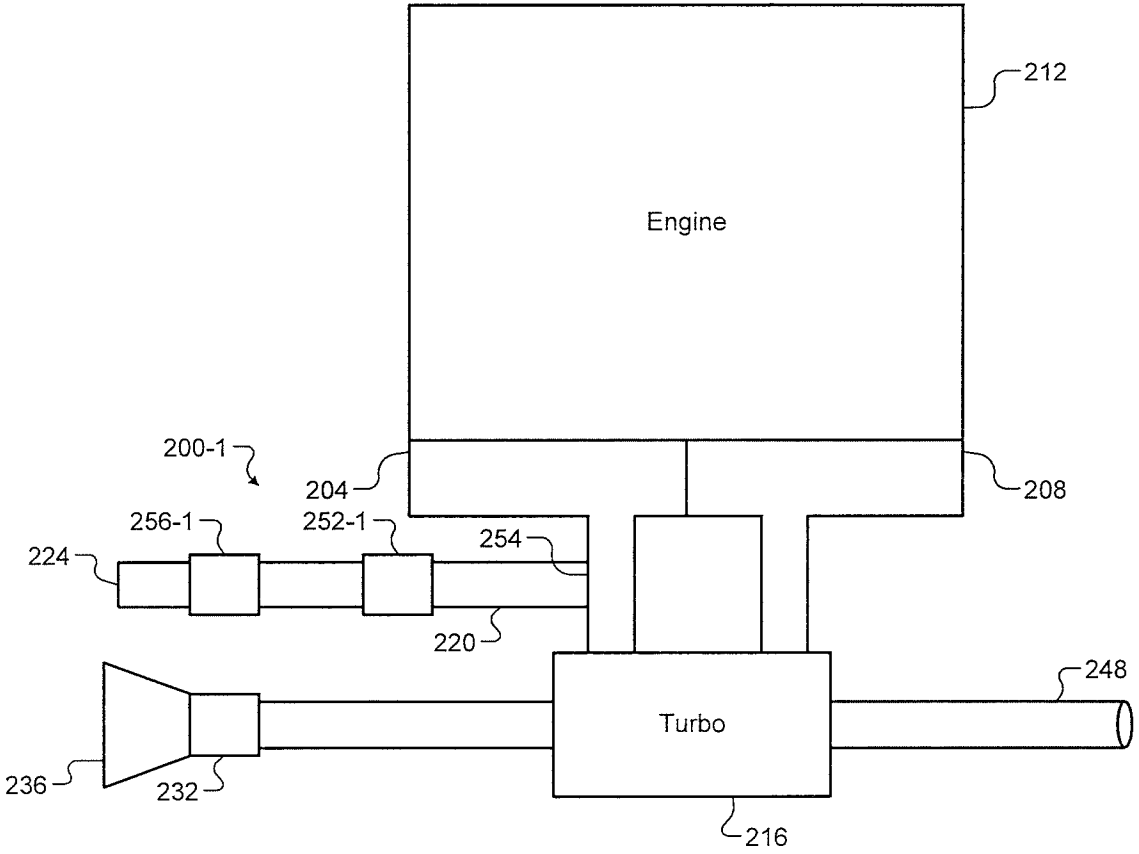
FIG. 2A illustrates a first example engine sound enhancement system according to the principles of the present disclosure.
Figure 2B:
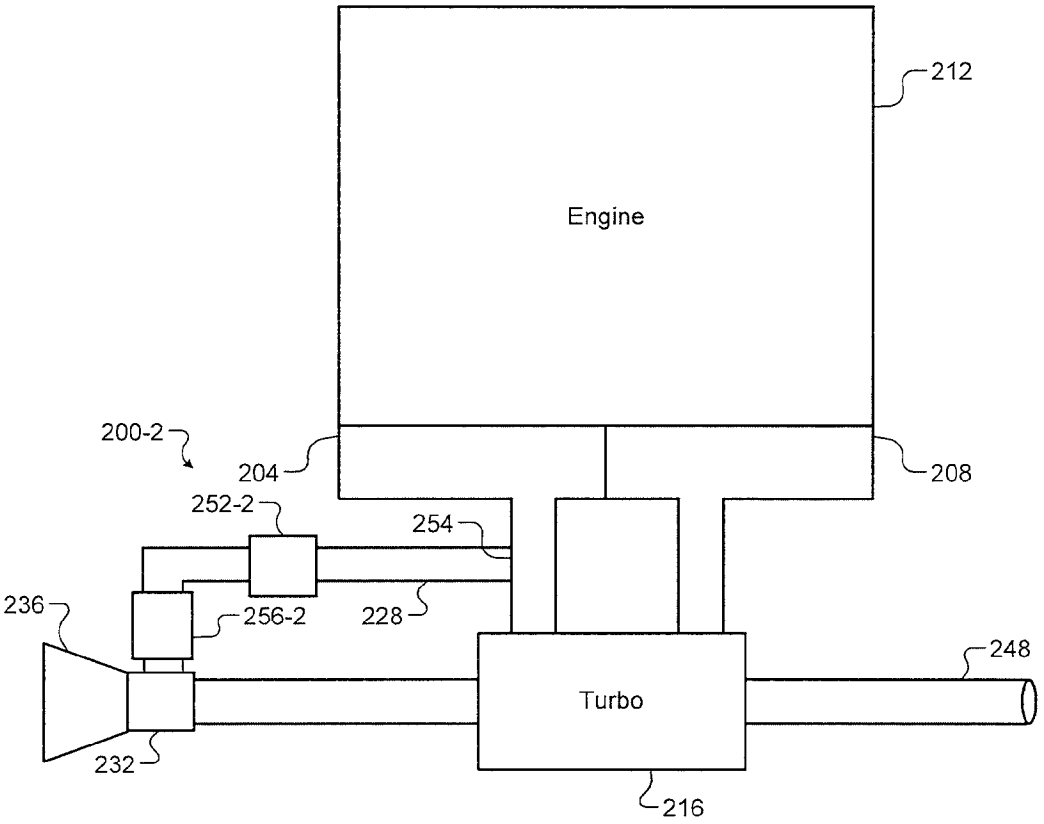
FIG. 2B illustrates a second example engine sound enhancement system according to the principles of the present disclosure.
Figure 2C:
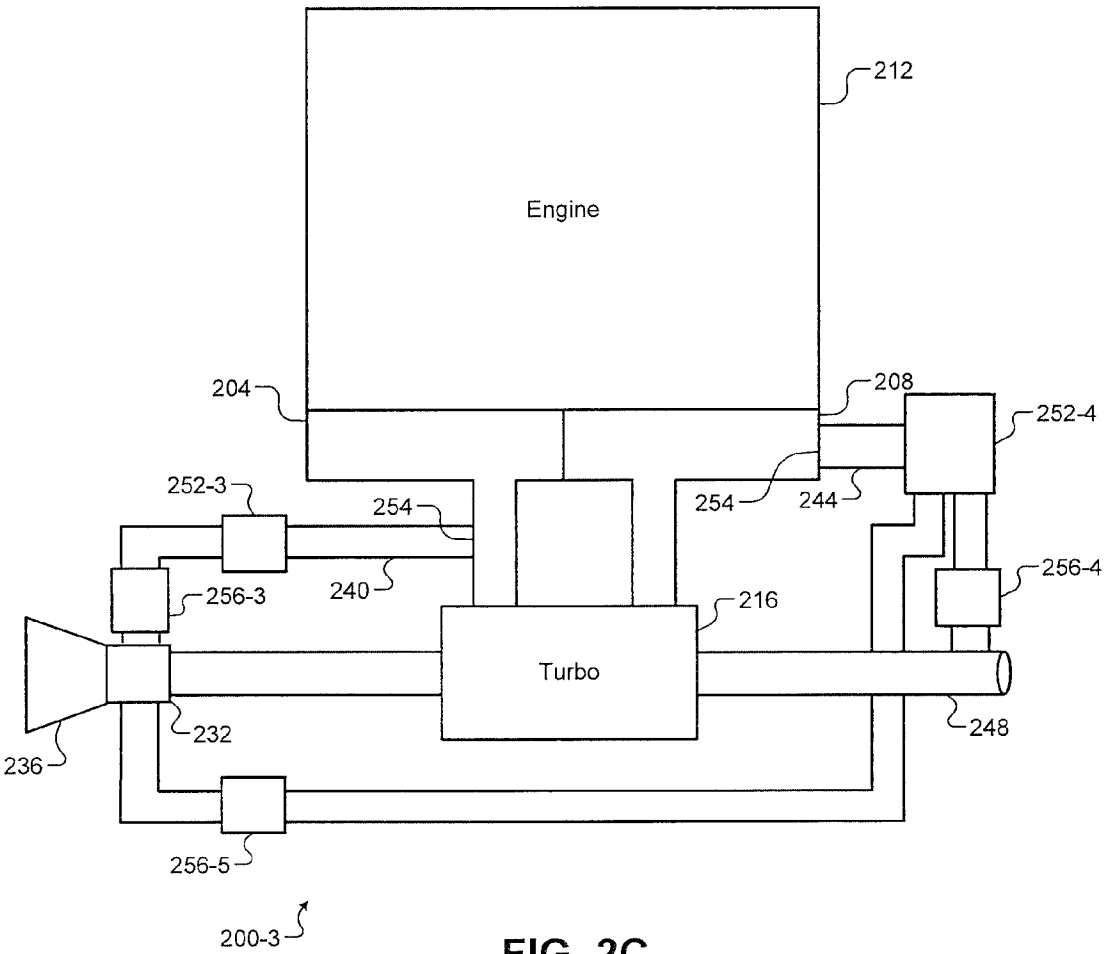
FIG. 2C illustrates a third example engine sound enhancement system according to the principles of the present disclosure.

FIGS. 2A, 2B, and 2C show respective example engine sound enhancement systems 200-1, 200-2, and 200-3, referred to collectively as engine sound enhancement systems 200. Each of the systems 200 communicate with various portions of an intake manifold 204 and/or an exhaust manifold 208, which are in turn in fluid communication with an engine 212 and a turbocharger 216. In FIG. 2A, a conduit 220 provides a sound flow path from the intake manifold 204 to an exterior of the vehicle (e.g., via external port 224). In FIG. 2B, a conduit 228 provides a sound flow path from the intake manifold 204 to an air intake 232 (e.g., to the air intake 232, a snorkel 236, etc.). In FIG. 2C, a first conduit 240 provides a sound flow path from the intake manifold 204 to the air intake 232. A second conduit 244 provides a sound flow path from the exhaust manifold 208 to the air intake 232 and a sound flow path from the exhaust manifold 208 to an exhaust pipe 248. For example only, the second conduit 244 may communicate with a waste gate channel of the exhaust manifold 208.

Each of the systems includes engine sound enhancement devices 252-1, 252-2, 252-3, and 252-4 (referred to collectively as engine sound enhancement devices 252) arranged in the sound flow paths of the respective conduits 220, 228, 240, and 244. The engine sound enhancement devices 252 are responsive to pulses (e.g., acoustic/pressure pulses) in the intake manifold 204 and the exhaust manifold 208. For example, the devices 252 may include a membrane that resonates in response to the pulses and/or an electronic device (e.g., a microphone and speaker). The electronic device would convert the pulses to signals to be output by the speaker. The signals may be amplified, and/or modified (e.g., filtered) to remove undesirable characteristics (e.g., undesirable resonances, frequencies, tones, etc.).

The conduits 220, 228, 240, and 244 may or may not be in fluid communication with the intake manifold 204 and the exhaust manifold 208, respectively. For example, a diaphragm, membrane, or other type of interface 254 may be arranged in respective inlets of the conduits between the conduits and intake manifold 204 or exhaust manifold 208, and/or merely adjacent to surfaces of the intake manifold 204 or exhaust manifold 208. Additionally or alternatively, the interfaces 254 may be provided within the respective devices 252. The interfaces 254 do not allow exhaust or intake air flow into the conduits. Instead, the interfaces 254 are responsive to pulses in the intake manifold 204 and the exhaust manifold 208. For example, the interfaces 254 may be responsive to changes in pressure, sound, etc. within the intake manifold 204 and the exhaust manifold 208. The interfaces 254 may resonate or vibrate and transfer associated sound and pressure changes into the conduits, devices 252, etc. In embodiments that include electronic components (e.g., a microphone and/or speaker), the interfaces 254 may include sound transducers that convert the sound or pressure changes into an electronic signal.

In this manner, enhanced engine sound is provided to an exterior of the vehicle via the port 224, the air intake 232 (e.g., via the snorkel 236), and/or the exhaust pipe 248 without interfering with intake air flow or exhaust flow. Valves 256-1, 256-2, 256-3, 256-4, and 256-5 (referred to collectively as valves 256) may be provided in the sound flow paths of the respective conduits 220, 228, 240, and 244. The valves 256 are selectively actuated to modulate engine sound enhancement as described below in further detail.

Figure 3:
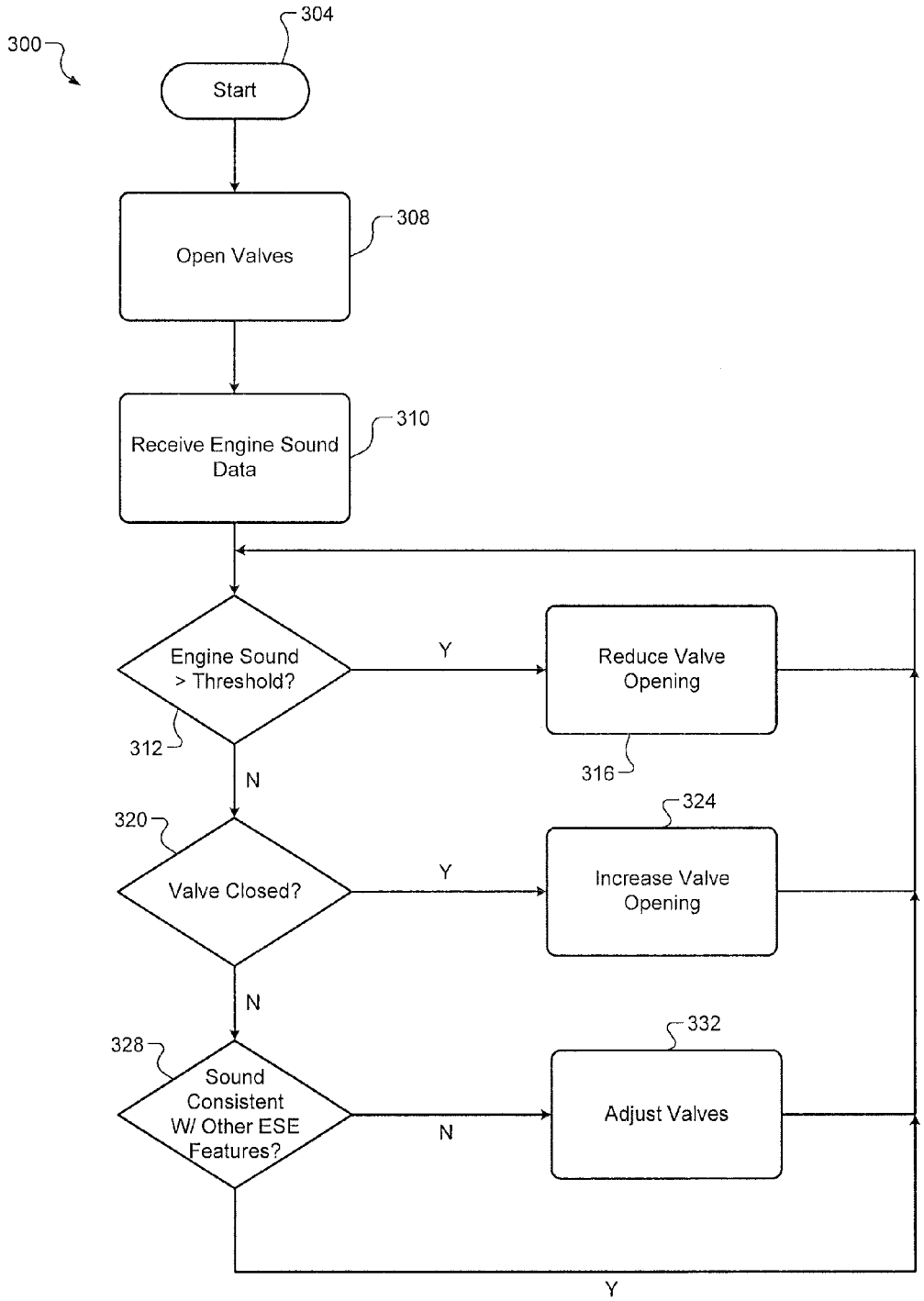
FIG. 3 illustrates an example engine sound enhancement method according to the principles of the present disclosure.

Referring now to FIG. 3, an example engine sound enhancement method 300 begins at 304. At 308, engine sound enhancement valves (e.g., the valves 256) are actuated to a default position (e.g., upon engine start up, in response to control signals received from the ECM 114). While the default position corresponds to a fully open position in the present example, the default position may correspond to a closed or intermediate (partially open or partially closed) position in other examples. At 312, the method 300 (e.g., the ECM 114) determines whether sound caused by the engine with the valves in the present position is greater than a threshold. If true, the method 300 continues to 316. If false, the method 300 continues to 320. For example, the threshold may be predetermined or calibrated, adjustable based on user inputs (such as a selected engine performance mode), adjustable based on location (e.g., as determined according to GPS signals), etc. The sound caused by the engine may be calculated (e.g., by the ECM 114) based on engine parameters including, but not limited to, engine speed, torque, vehicle speed, selected transmission gear, etc.

At 316, the method 300 (e.g., the ECM 114) reduces the openings of the valves. At 320, the method 300 (e.g., the ECM 114) determines whether the valves are closed. If true, the method 300 continues to 324. If false, the method 300 continues to 328. At 324, the method 300 (e.g., the ECM 114) increases the openings of the valves.

At 328, the method 300 (e.g., the ECM 114) determines whether the engine sound (e.g., as calculated according to speed, torque, etc.) is consistent with other engine sound enhancement (ESE) features of the vehicle. For example, other ESE features include, but are not limited to, sound quality valves located throughout the exhaust system of the vehicle that may be opened and closed to adjust engine sound, engine sound enhancement features implemented by an interior audio system of the vehicle, etc. If true, the method 300 continues to 312. If false, the method 300 continues to 332.

At 332, the method 300 (e.g., the ECM 114) adjusts the openings of the valves based on other ESE features. For example, if other ESE features are reduced, the openings of the valves may be reduced. If the other ESE features are disabled (e.g., a selected performance mode disables all ESE features), the valves may be closed.

Although, as described above, the method 300 reduces and increases the openings of each of the valves at 316, 324, and 332, in other examples the valves may be actuated independently of one another. The valves may be adjusted in predetermined increments or using any other suitable control scheme.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of,""above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. An engine sound enhancement system having a turbocharger with a compressor and a turbine comprising:

a first conduit in communication with an intake manifold and a seocnd conduit in communication with an exhaust manifold of an engine, wherein an outlet of the second conduit is in communication with an exhaust pipe; and an interface arranged at least one of (i) within the first conduit and (ii) between an inlet of the at least one of the first conduit and the intake manifold, and the second conduit and the exhaust manifold, wherein the interface is responsive to pulses within the at least one of the intake manifold and the exhaust manifold, wherein the interface is configured to transfer the pulses into the at least one of the first conduit and the second conduit, wherein an outlet of the first conduit is in communication with an air intake of the turbocharger.

2. The system of claim 1, wherein the pulses correspond to at least one of changes in sound and changes in pressure.

3. The system of claim 1, wherein the interface is arranged at least one of (i) adjacent to a surface of the at least one of the intake manifold and the exhaust manifold and (ii) in an opening between the conduit and the at least one of the intake manifold and the exhaust manifold.

4. The system of claim 1, further comprising an engine sound enhancement device arranged within the conduit, wherein the interface is located within the engine sound enhancement device.

5. The system of claim 4, wherein the engine sound enhancement device includes a sound transducer that converts the pulses to a signal.

6. The system of claim 5, wherein the engine sound enhancement device includes a speaker that outputs engine sound based on the signal.

7. The system of claim 5, wherein the engine sound enhancement device at least one of filters, attenuates, and amplifies the signal.

8. An engine sound enhancement system, comprising:

a first conduit in communication with an intake manifold and a second conduit in communication with an exhaust manifold of an engine;

an interface arranged at least one of (i) within the first conduit and (ii) between an inlet of the at least one of the first conduit and the intake manifold and the second conduit and the exhaust manifold, wherein the interface is responsive to pulses within the at least one of the intake manifold and the exhaust manifold, wherein the interface is configured to transfer the pulses into the at least one of the first conduit and the second conduit; and a valve arranged within at least one of the first conduit and the second conduit.

9. An engine sound enhancement method for a vehicle, the method comprising:

providing a first conduit in communication with an intake manifold and a second conduit in communication with an exhaust manifold of an engine;

arranging a valve within at least one of the first conduit and the second conduit;

arranging an interface at least one of (i) within the first conduit and (ii) between an inlet of the at least one of the first conduit and the intake manifold and the second conduit and the exhaust manifold, wherein the interface is responsive to pulses within the at least one of the intake manifold and the exhaust manifold; and transferring the pulses into the at least one of the first conduit and the second conduit using the interface.

10. The method of claim 9, wherein the pulses correspond to at least one of changes in sound and changes in pressure.

11. The method of claim 9, wherein arranging the interface includes arranging the interface at least one of (i) adjacent to a surface of the at least one of the intake manifold and the exhaust manifold and (ii) in an opening between the conduit and the at least one of the intake manifold and the exhaust manifold.

12. The method of claim 9, further comprising arranging an engine sound enhancement device within the conduit, wherein the interface is located within the engine sound enhancement device.

13. The method of claim 12, further comprising converting the pulses to a signal using the engine sound enhancement device and outputting engine sound based on the signal.

14. The method of claim 13, further comprising at least one of filtering, attenuating, and amplifying the signal.

15. The method of claim 9, wherein an outlet of the conduit is in communication with at least one of an air intake of a turbocharger, a compressor discharge of a turbocharger, an exhaust pipe, and an exterior of the vehicle.

* * * * *